United States Patent [19]

Pankratz et al.

[11] Patent Number: 4,850,802

[45] Date of Patent: Jul. 25, 1989

[54] COMPOSITE COMPRESSOR WHEEL FOR TURBOCHARGERS

[75] Inventors: Allan W. Pankratz, Carson; Bogumil J. Matysek, Torrance; Ralph A. Mendelson, Anaheim, all of Calif.

[73] Assignee: Allied-Signal Inc., Morristown, N.J.

[21] Appl. No.: 487,142

[22] Filed: Apr. 21, 1983

[51] Int. Cl.[4] ..... F01D 5/14

[52] U.S. Cl. ..... 416/213 R; 416/241 R; 29/156.8 R; 228/113

[58] Field of Search ..... 416/185, 186, 213 R, 416/241 R, 294 A; 415/212; 29/445, 156.8 R; 228/112–114

[56] References Cited

U.S. PATENT DOCUMENTS

| | | | |
|---|---|---|---|
| 1,681,906 | 8/1928 | Taylor, Jr. | 29/156.8 R |
| 1,849,186 | 3/1932 | Grau et al. | 29/156.8 R |
| 1,884,252 | 10/1932 | Robinson | 416/244 R |
| 2,101,149 | 12/1937 | Martin | 29/156.8 R |
| 2,432,315 | 12/1947 | Howard | 416/213 R |
| 2,438,866 | 3/1948 | Rockwell et al. | 29/156.8 CF |
| 2,440,317 | 4/1948 | Welsh | 416/186 R |
| 2,456,779 | 12/1948 | Goetzel | 416/248 |
| 2,479,039 | 8/1949 | Cronstedt | 416/204 R |
| 2,579,583 | 12/1951 | Johnson | 29/156.8 R |
| 2,612,442 | 9/1952 | Goetzel | 428/555 |
| 2,703,922 | 3/1955 | Brauchler et al. | 29/156.8 R |
| 2,757,901 | 8/1956 | McVeigh | 428/557 |
| 2,769,611 | 11/1956 | Schwarzkopf | 416/219 R |
| 2,831,958 | 4/1958 | Richardson | 219/137 R |
| 2,894,318 | 7/1959 | Bloomberg | 29/156.8 R |
| 2,922,619 | 1/1960 | Slemmons | 416/244 R |
| 2,946,681 | 7/1960 | Probst et al. | 419/2 |
| 3,000,081 | 9/1961 | Webb | 29/156.8 R |
| 3,107,627 | 10/1963 | Clarke et al. | 29/156.8 CF |
| 3,158,353 | 11/1964 | Reid et al. | 416/220 R |
| 3,394,918 | 7/1968 | Wiseman | 416/241 R |
| 3,421,201 | 1/1969 | Oberle | 228/113 X |
| 3,559,277 | 2/1971 | Marianeschi | 29/156.8 R |
| 3,571,906 | 3/1971 | Barth | 228/113 |
| 3,650,635 | 3/1972 | Wachtell et al. | 415/115 |
| 3,660,882 | 5/1972 | Widowitz et al. | 29/156.8 R |
| 3,666,302 | 5/1972 | Kellett | 416/244 R X |
| 3,734,697 | 5/1973 | Sieghartner | 29/156.8 R |
| 3,748,110 | 7/1973 | Hodshire et al. | 428/652 |
| 3,773,506 | 11/1973 | Larker et al. | 75/208 R |
| 3,778,188 | 12/1973 | Aspinwall | 416/97 |
| 3,790,303 | 2/1974 | Endres | 416/241 R |
| 3,844,727 | 10/1974 | Copley et al. | 29/191.6 |
| 3,893,817 | 7/1975 | Hackbarth | 29/156.8 CF |
| 3,905,722 | 9/1975 | Guy et al. | 416/193 |
| 3,940,268 | 2/1976 | Catlin | 75/208 R |
| 4,074,559 | 2/1978 | Beane | 29/156.8 R |
| 4,087,038 | 5/1978 | Yagi | 228/112 |
| 4,150,557 | 4/1979 | Walker et al. | 29/156.8 R |
| 4,152,816 | 5/1979 | Ewing | 416/213 R X |
| 4,335,997 | 6/1982 | Ewing et al. | 416/241 R X |

FOREIGN PATENT DOCUMENTS

| | | | |
|---|---|---|---|
| 514244 | 11/1939 | United Kingdom | 416/244 A |

*Primary Examiner*—Robert E. Garrett
*Assistant Examiner*—Joseph M. Pitko
*Attorney, Agent, or Firm*—Ken C. Decker

[57] ABSTRACT

A composite compressor wheel for turbochargers and the like comprises a cast shell having aerodynamically contoured centrifugal impeller blades and a hub section defining a generally conical recess into which a hub insert of noncast material resistant to stress failure is secured as by inertia welding. In use of the composite wheel, the hub insert substantially occupies high stress regions within the wheel to improve wheel fatigue life.

28 Claims, 2 Drawing Sheets

COMPOSITE COMPRESSOR WHEEL FOR TURBOCHARGERS

BACKGROUND OF THE INVENTION

This invention relates generally to compressor wheels or impellers of the general type used commonly with centrifugal compressors in turbochargers, superchargers, and the like. More specifically, this invention relates to an improved centrifugal compressor wheel and its method of manufacture wherein the compressor wheel is designed for substantially prolonged fatigue life.

Centrifugal compressor wheels in general are well known for use in turbochargers, superchargers, and the like wherein the wheel comprises an array of aerodynamically contoured impeller blades supported by a central hub section which is in turn mounted on a rotatable shaft for rotation therewith. In the context of a turbocharger, by way of example, the hub section includes a central axial bore through which the shaft extends, and a nut is fastened over the shaft at the nose end of the wheel to hold the hub section tightly against a shaft shoulder or other diametrically enlarged structure rotatable with the shaft. The shaft thereby rotatably drives the compressor wheel in a direction such that the contoured blades axially draw in air and discharge that air radially outwardly at an elevated pressure level into a chamber of a compressor housing. The pressurized air is then supplied from the chamber to the air intake manifold of a combustion engine for admixture and combustion with fuel, all in a well-known manner.

In recent years, improvements in compressor technology and design have resulted in progressive increases in compressor efficiencies and flow ranges, together with more rapid transient response characteristics. For example, compressor wheels for turbochargers are well known wherein the impeller blades exhibit compound and highly complex curvatures designed for optimum operational effeciency and flow range. Such complex blade shape is most advantageously and economically obtained by a casting process wherein the wheel hub section and blades are integrally formed desirably from a lightweight material, such as aluminum or aluminum alloy chosen for its relatively low rotational inertia for achieving the further advantage of rapid accelerative response during transient operating conditions.

Cast compressor wheels of this general type, however, have a relatively short, finite fatigue life resulting in undesired incidence of fatigue failure during operation. More specifically, when compressor wheel is rotated at operating speeds up to 100,000 rpm or more, cast aluminum, material is subjected to relatively high tensile loading in a radial direction particularly in the hub region of the wheel which must support the radial wheel mass. The impact of this tensile loading can be especially severe when the wheel is operated in a relatively high-speed, rapid speed cycle environment, such as, for example, turbochargers used with earth-moving equipment, front-end loaders, back hoes, and the like. Unfortunately, the hub region of the cast wheel is a site of congreated metallurical imperfections, such as dross, inclusions, and voids, which inherently result from the casting process. The presence of these imperfections in the vicinity of the central bore, which acts as a stress riser, renders the wheel highly susceptible to stress or fatigue fracture in the hub region.

It is known that fatigue failures in compressor wheels can be significantly reduced, or alternately stated, the fatigue life of the compressor wheel can be substantially prolonged by forming the wheel from a noncast material, such as a forged or wrought aluminum or aluminum alloy, thereby avoiding the internal imperfections inherently resulting from a casting process. However, such noncast compressor wheels have not been practical from a cost or manufacturing standpoint primarily due to the complex machining requirements to form the impeller blades with the desired aerodynamic contours.

The present invention overcomes the problems and disadvantages of prior compressor wheels for turbochargers and the like by providing an improved compressor wheel formed from composite materials including cast impeller blades of desired aerodynamic contour and a noncast hub region for improved fatigue life, wherein the cast and noncast materials are secured together in a manner consistent with high production rate manfacturing processes.

SUMMARY OF THE INVENTION

In accordance with the invention, a composite compressor wheel is provided for connection to the rotating shaft of a turbocharger, supercharger, or the like. The composite compressor wheel is formed from relatively lightweight, low inertia material, such as aluminum or a selected aluminum alloy to include a cast shell having aerodynamically contoured impeller blades formed integrally with a hub section having a recess formed in the base thereof. A hub insert of a noncast material, such as forged or wrought aluminum or aluminum alloy resistant to fatigue failure, is secured into the recess in the shell hub section, wherein the noncast hub insert is sized and shaped to occupy regions within the compressor wheel subjected to relatively high stress during operation.

In accordance with a preferred form of the invention, the cast shell including the impeller blades and the hub section is formed by a conventional casting process wherein the hub section is modified from a conventional wheel geometry to include the recess in the base thereof having a generally right conical configuration centered on a central axis of the wheel and tapering from a base diameter at the wheel base toward an apex position near the wheel nose. The included angle between the apex and the base diameter of the conic recess is chosen to maximize volumetric penetration into the hub section consistent with providing the hub section with sufficient radial thickness for structural support of the impeller blades. A relatively small gate passage is also formed in the shell to communicate between the apex of the recess and the nose of the cast shell.

The hub insert is formed perferably from a forged or wrought material to have a generally conical size and shape closely matching the size and shape of the recess formed in the hub section of the cast shell. The hub insert is received into the recess and secured therein to the cast shell as by inertia welding which forms a substantially continuous and uninterrupted bond of uniform strength therebetween.

Subsequent to attachment of the hub insert to the cast shell, the base or back side of the resultant composite compressor wheel is machined to the desired surface finish and configuration and to remove weld flash or upset material from the wheel base. In addition, a central axial bore is formed in the wheel with a diameter sufficient to remove the gate passage and any weld flash or upset material contained therein. The thus-formed composite compressor wheel can then be installed in a conventional manner onto the rotatable shaft of a turbocharger or the like.

In operation, the conical hub insert occupies substantially those internal portions of the composite wheel subjected to relatively high tensile loading, wherein the hub insert is resistant to stress failure as a result of such loading to provide the compressor wheel with a prolonged fatigue life.

Other features and advantages of the present invention will become more apparent from the following detailed description, taken in conjunction with the accompanying drawings, which illustrate, by way of example, the principles of the invention.

BRIEF DESCRIPTION OF THE DRAWINGS

The accompanying drawings illustrate the invention. In such drawings:

FIG. 1 is a perspective view illustrating a centrifugal compressor wheel for use with a turbocharger or the like;

FIG. 5 is a vertical section of the composite compressor wheel in completed form ready for installation into a turbocharger or the like.

DETAILED DESCRIPTION OF THE PREFERRED EMBODIMENT

Figure 1:
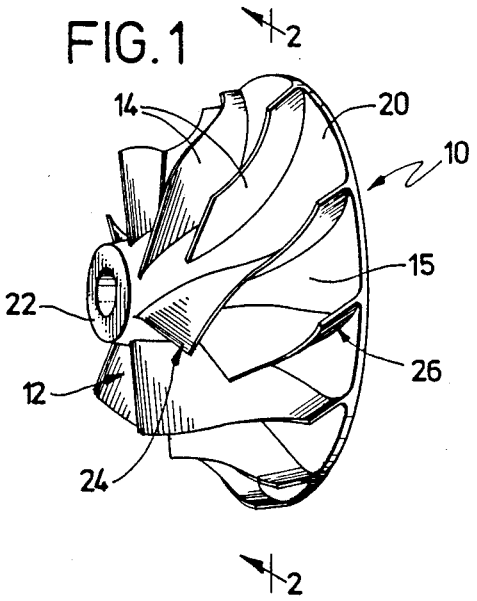

As shown in the exemplary drawings, a composite compressor wheel referred to generally by the reference numeral 10 is provided for use as a centrifugal impeller in a turbocharger, supercharger, or the like. The composite compressor wheel 10 comprises a cast shell 12 shown in FIG. 1 to include an array of aerodynamically contoured impeller blades 14 formed integrally with a hub section 15 into the base of which a hub insert 16 (not visible in FIG. 1) of a noncast material is secured. Both the cast shell 12 and the hub insert 16 are adapted to be formed from an aluminum or aluminum alloy to provide a wheel which is light in weight and has a relatively low rotational inertia for rapid operational response to transient conditions.

The composite compressor wheel of this invention provides substantial improvements in wheel fatigue life over conventional centrifugal compressor wheels of the type used in turbochargers, superchargers, and the like, without sacrificing efficiency and flow range in accordance with a preferred aerodynamic contouring of the impeller blades 14. This blade contouring includes complex and compound blade curvatures which effectively prohibit manufacture of the blades by any means other than a casting process, such as a rubber pattern or lost wax process. Alternately stated, this complex blade contouring renders other forming techniques, such as forging, machining, and the like, impossible or economically unfeasible. Accordingly, in the past, centrifugal compressor wheels for turbochargers have been formed from a unitary casting wherein the blades are cast integrally with a wheel hub through which a central axial bore is formed as by drilling to permit mounting onto the rotating shaft of a turbocharger or the like, all in a well-known manner. To minimize rotational inertia of the compressor wheel and thereby achieve a desired rapid response to transient operating conditions, the cast wheel is normally formed from aluminum or a lightweight aluminum alloy.

More particularly, with reference to FIG. 1, which illustrates the preferred blade contouring with respect to the composite compressor wheel of the present invention, the impeller blades 14 are supported integrally from the hub section 15 which includes at one axial end a diametrically enlarged backplate disk 20 and blends smoothly toward a nose 22 of lesser diameter at the opposite axial end of the hub section. The blades 14 project radially outwardly from the hub section 15 with a complex and smoothly curved shape to draw air or the like axially in at the nose end and to discharge that air radially outwardly from the backplate disk. The specific blade contouring typically includes a forward blade rake generally adjacent the nose 22 for at least some of the blades 14, as illustrated by arrow 24 in FIG. 1, and at least some backward curvature near the periphery of the backplate disk 20, as referred to by arrow 26.

However, cast aluminum or aluminum alloy from which the blades are desirably formed is susceptible to stress failures as a result of metallurigical imperfections, such as dross, voids, and inclusions, which inherently occur during a casting process. With an integrally cast wheel, these imperfections tend to congregate in the hub region of the shell where tensile stress acting in a radial direction are highest as the wheel is accelerated and decelerated during operation. These imperfections act as stress risers and thus constitute initiation sites for stress cracks. Unfortunately, these imperfections are located in the vicinity of a major void, namely, the central bore formed in the wheel, wherein the bore itself acts as a major stress riser during wheel rotation.

Figure 2:
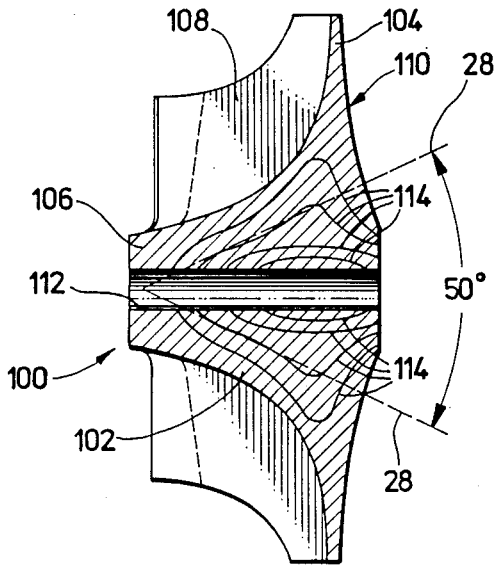
FIG. 2 illustrates in vertical section a prior art centrifugal compressor wheel having superimposed thereon stress lines indicative of tensile stress loading encountered by the wheel during operation.

The exposure of a centrifugal compressor wheel to radially directed tensile stress during operation is illustrated more clearly with respect to FIG. 2 which shows an integrally cast compressor wheel 100 in vertical section. As illustrated, the cast wheel 100 comprises a hub 102 including a diametrically enlarged backplate disk 104 blending smoothly toward a reduced diameter nose 106 and supporting an array of contoured blades 108 having a shape generally in accordance with the blade shape described with respect to FIG. 1. The base side of the backplate disk 104 is typically relieved partially as by machining to a desired aerodynamic shape, as illustrated by arrow 110, and a central axial bore 112 is formed through the hub 102 for reception of a rotating shaft of a turbocharger or the like.

When the wheel 100 is rotated, each internal increment thereof is subjected to a radial tensile loading which varies in magnitude in accordance with the rotational speed of the wheel and further in accordance with the wheel mass disposed radially outwardly from that increment. This radial loading is illustrated in FIG. 2 by superimposed stress lines 114 indicating regions of constant stress encountered during rotation by annular internal regions of the wheel. The relatively highest stress regions are within the hub 102, with stresses of higher magnitude being encountered closer to the central bore 112. At rated operating speed, stress values on the order of 40,000 to 50,000 psi are commonly encountered wherein such stresses, particularly in combination with frequent cyclic loading, can result in stress failure. The likelihood of stress failure is dramatically increased by the presence of internal metallurgical imperfections as described above.

The present invention provides a substantially improved centrifugal compressor wheel by forming high stress regions of the wheel hub from a noncast material, such as a forged or wrought aluminum or aluminum alloy, which tends not to include internal metallurgical imperfections of the type encountered with cast materials. More particularly, the noncast material has a longer fatigue life than cast materials and is provided in a generally conical region of the wheel hub, as represented by the dotted lines 28 in FIG. 2. The remaining portion of the wheel including the impeller blades is advantageously formed by casting for optimum blade contours. Importantly, the cast and noncast portions of the wheel are secured to one another in a stable manner consistent with high production manufacturing processes to provide a composite compressor wheel designed for installation directly into a turbocharger or the like without requiring any modification to the turbocharger or alteration of the wheel mounting method.

Figure 3:
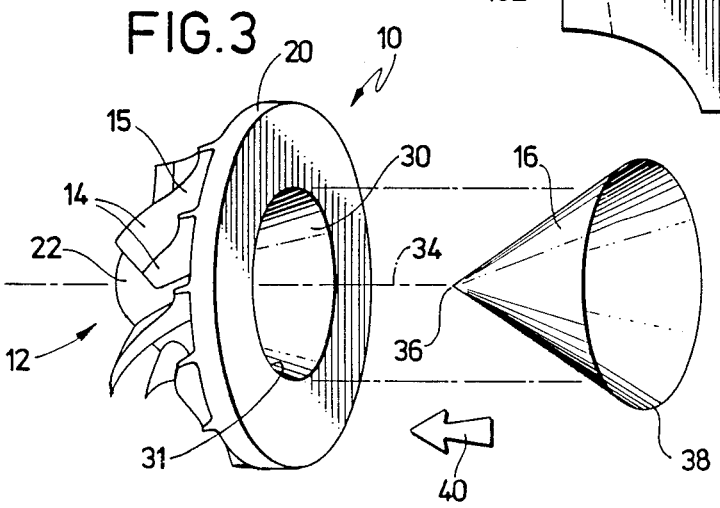
FIG. 3 is an exploded perspective view illustrating an initial step in the formation of the composite wheel embodying the novel features of the invention.

With reference to FIG. 3, the composite compressor wheel 10 of the present invention comprises the cast shell 12 formed from aluminum or a selected aluminum alloy by a suitable casting process to include the hub section 15 cast integrally with the array of aerodynamically contoured impeller blades 14. The base or back side of the cast shell 12, within the hub section 15, is shaped to define a generally right conical recess 30 extending from a base diameter 31 centered generally on a central axis 34 of the shell 12 in the plane of the backplate disk 20 toward an apex 32 positioned near the nose 22 along the central axis 34. Accordingly, this conical recess 30 leaves unoccupied that portion of the hub section 15 where tensile stresses of substantial magnitude would be encountered during operation. The specific included angle of the conical recess 30, measured between its apex 32 and its base diameter 31, is chosen for maximum axial and radial penetration of the recess into the hub section consistent with providing the hub section with sufficient radial thickness for structral support of the impeller blades 14. While this included angle may therefore vary in accordance with the overall size and shape of the compressor wheel, a preferred included angle for a typical turbocharger application is on the order of about 50 degrees.

The hub insert 16 is formed from a noncast material, such as a forged or wrought material, preferably a low inertia material, such as aluminum or an aluminum alloy. The hub insert is shaped to have a generally conical configuration which can be formed quickly, easily, and relatively inexpensively by machining a solid billet of material, or by any other means consistent with forming the hub insert from a material having a substantially longer fatigue life in comparison with the cast shell. Importantly, the hub insert is shaped to have an axial dimension at least slightly greater than the axial dimension of the shell recess 30 and further to have an included angle measured between the hub insert apex 36 and base diameter 38 relatively closely matching the included angle of the shell recess 30, with a permitted angular deviation being on the order of about $\pm 0.5$ degree.

The hub insert 16 is received into the recess 30 of the cast shell 12 and suitably secured thereto to provide the solid composite compressor wheel 10 having cast contoured blades 14 and failure-resistant noncast material in high stress internal regions. While various connection techniques, such as brazing, are possible, the preferred method comprises inertia welding wherein, for example, the cast shell 12 is held within a rotatable fixture (not shown) while the hub insert 16 is held against rotation by an appropriate tool (also not shown) and the two are advanced in the direction of arrow 40 in FIG. 3. The hub insert 16 is held within the shell recess 30 under influence of an appropriate axial force an while in friction contact with the rotating cast shell 12 to generate sufficient heat for fusion of the conical interface between the cast shell 12 and the hub insert 16. This results in a high quality, substantially uninterrupted and continuous welded bond over substantially the entire mating surface areas of the conical interface.

Figure 4:
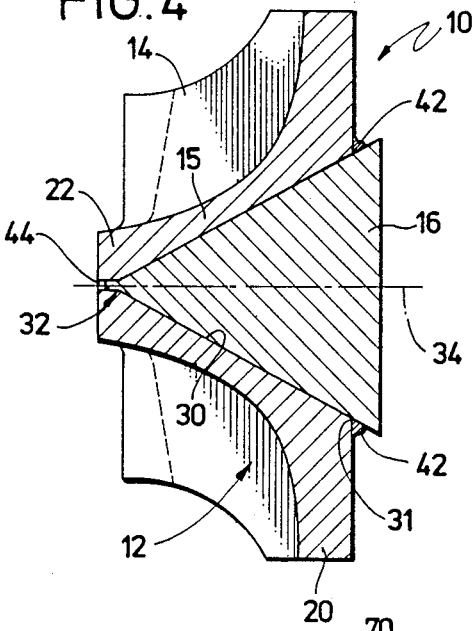
FIG. 4 is an enlarged vertical section of the composite compressor wheel illustrating the wheel in an intermediate stage of manufacture.

During the welding process, at least some of the material of the cast shell 12 and the hub insert 16 is displaced as upset or flash material 42 in the vicinity of the recess base diameter 31 and apex 32. The upset or flash material 42 at the base diameter 31 accumulates generally on the base or back side of the backplate disk 20, whereas the material 42 at the apex 32 accumulates within a relatively small gate passage 44 formed in the cast shell 12 and open to the wheel nose 22, as viewed in FIG. 4. This gate passage 44 can be formed either during casting of the shell or subsequently, if desired, as by drilling or the like.

Figure 5:
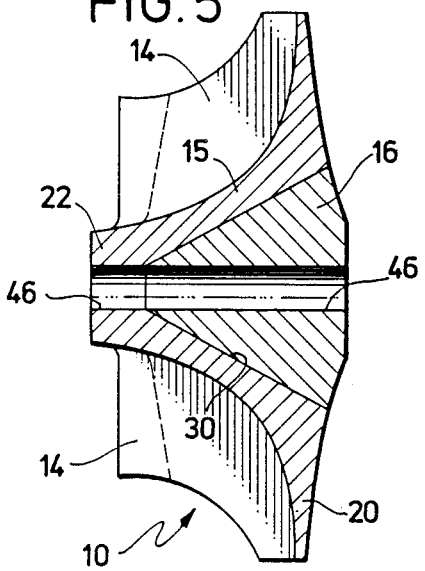

As shown in FIG. 5, the thus-formed composite wheel comprising the cast shell 12 and the hub insert 16 is processed to remove the upset or flash material 42 and further to provide the wheel with a central bore 46 for receiving the rotating shaft of a turbocharger or the like. More particularly, the base or back side of the composite wheel is relieved as by machining sufficiently to remove the upset or flash material 42 as well as any excess portion of the hub insert 16, and further to provide the wheel base with a selected aerodynamic contour and surface finish. Such machining advantageously removes a small portion of the welded conical interface between the shell 12 and the hub insert 16 wherein such removed portion is that portion most likely to have achieved an unsatisfactory welded bond during the inertia welding step. In addition, the central axial bore 46 is formed in the wheel as by drilling or the like to remove the gate passage 44 and any upset or flash material 42 therein. Importantly, formation of the bore also removes a portion of the welded conical interface between the shell 12 and hub insert 16 generally at the apex 32 of the shell recess, wherein this removed portion of the welded interface may have achieved an unsatisfactory welded bond as a result of close proximity to the wheel central axis.

Figure 6:
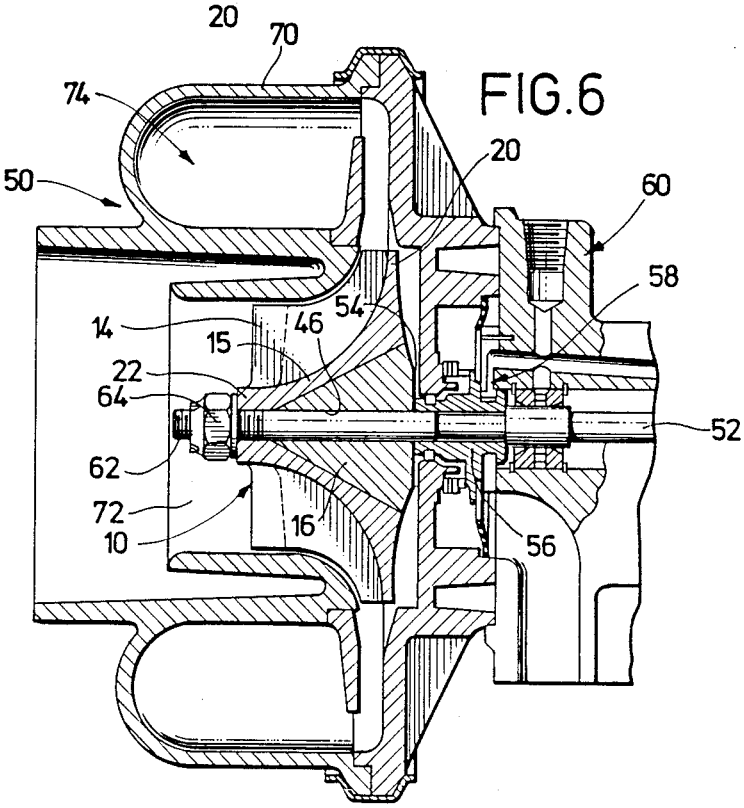
FIG. 6 is a fragmented vertical section illustrating the composite compressor wheel of FIG. 5 installed into a turbocharger.

The composite compressor wheel 10 can then be installed directly into a turbocharger or the like in a conventional manner without requiring any modification to the turbocharger or alteration of the installation method. More particularly, with reference to FIG. 6, the composite compressor wheel 10 can be installed into a turbocharger 50 with the rotating shaft 52 thereof received through the central axial bore 46 of the wheel. As illustrated, the wheel 10 is received over the shaft 46 to a position with the wheel base 54 in axial bearing contact with a rotatable spacer 56 of a thrust bearing assembly 58 conventionally provided within the center housing 60 of a turbocharger. The end of the shaft projecting through the compressor wheel 10 terminates in a threaded portion 62 over which a nut 64 is tightened to secure the wheel firmly onto the shaft for rotation therewith.

In operation, the composite compressor wheel 10 is positioned within a compressor housing 70 mounted onto the tubocharger center housing 60 to draw in air through an inlet 72 and to discharge that air radially outwardly into a compressor chamber 74 in the compressor housing 70. This air movement occurs in response to rotational driving of an exhaust gas turbine (not shown) which drivingly rotates the turbocharger shaft 46 to correspondingly rotate the compressor wheel 10 at a relatively high rotational speed. Importantly, in accordance with the present invention, the failure-resistant hub insert 16 of the wheel 10 occupies substantially the internal regions of the wheel which encounter relatively high tensile loading during wheel rotation whereby the composite compressor wheel 10 has a substantially prolonged fatigue life in comparision with conventional unitary cast wheels. Operational efficiency and overall flow range of the composite compressor wheel 10, however, is not impaired, since the impeller blades 14 are formed from a casting process for optimum aerodynamic blade contour.

A variety of modifications and improvements to the composite compressor wheel described herein are believed to be apparent to those of ordinary skill in the art. Accordingly, no limitation on the invention is intended by way of the description herein, except as set forth in the appended claims.

What is claimed is:

1. A centrifugal compressor wheel for turbochargers and the like, comprising:

a blade shell having a hub section formed integrally with a circumferentially arrranged array of centrifugal impeller blades and a generally conical recess formed in said hub section with a base diameter generally at one axial end of said shell and an apex disposed generally on a central axis of said shell;

a hub insert having a size and shape generally for mating reception into the hub section recess and being secured to said shell with a substantially uninterrupted bond extending substantially over the entire conical interface between said hub insert and said shell, said hub insert being formed from a material relatively resistant to fatigue failure in comparison with said shell, and p1 a central axial bore formed through and bounded by said shell and said hub insert.

2. The compressor wheel of claim 1 wherein said shell is formed from a relatively lightweight cast material.

3. The compressor wheel of claim 2 wherein said shell is selected from the group consisting of aluminum and aluminum alloy.

4. The compressor wheel of claim 1 wherein said hub insert is formed from a relatively lightweight noncast material.

5. The compressor wheel of claim 4 wherein said hub insert is selected from the group consisting of aluminum and aluminum alloy.

6. The compressor wheel of claim 1 wherein said hub insert is inertia welded to said shell.

7. The compressor wheel of claim 1 wherein said hub insert has a size and shape to substantially occupy internal regions of said wheel subjected to relatively high stress during operation.

8. The compressor wheel of claim 1 wherein the hub section recess is shaped to have an included angle measured from its apex to its base diameter generally on the order of about 50 degrees.

9. The compressor wheel of claim 1 wherein said hub insert is shaped to have an included angle measured from its apex to its base diameter generally within about $\pm 0.5$ degree of the included angle of the hub section recess measured from the apex to the base diameter thereof.

10. The compressor wheel of claim 1 wherein said hub insert has an axial length at least slightly greater than the axial length of the hub section recess.

11. The compressor wheel of claim 1 wherein said shell further includes a relatively small gate passage extending generally along said central axis between the apex of the hub section recess and the opposite axial end of said shell.

12. A centrifugal compressor wheel for turbochargers and the like, comprising:

a blade shell formed from a relatively low inertia material to have a hub section formed integrally with a circumferentially arranged array of centrifugal impeller blades and a generally conical recess formed in said hub section with a base diameter generally at one end of said and an apex disposed generally on a central axis of said shell, said shell further including a relatively small gate passage extending generally along said central axis between the apex of the hub section recess and the opposite axial end of said shell;

a hub insert having a size and shape for generally mating reception into the hub section recess, said hub insert being formed from a relatively low inertia material relatively resistant to fatigue failure in comparison with said shell and comparable with said shell for inertia welding thereto;

each of said shell and hub insert, having inner peripheries on the same radial plane, defining a portion of a bore formed along the central axis of said shell and hub insert.

13. The compressor wheel of claim 12 wherein said shell is formed from a cast material, at least some of said blades having a forward blade rake generally at one axial end thereof and a rearward curvature generally at the other axial end thereof.

14. The compressor wheel of claim 13 wherein said shell is formed from an aluminum material, and wherein said hub insert is formed from a noncast aluminum material.

15. The compressor wheel of claim 12 wherein said hub insert is inertia welded to said shell matingly within the hub section recess.

16. A method of making a centrifugal compressor wheel for turbochargers and the like, comprising the steps of:

forming a blade shell to have a hub section integral with a circumferentially arranged array of centrifugal impeller blades and a generally conical recess in the hub section with a base diameter generally at one axial end of the shell and centered about a shell central axis and an apex disposed generally on the shell central axis;

forming a hub insert from a material relatively resistant to fatigue failure in comparison with the blade shell to have a size and shape for mating reception into the hub section recess;

securing the hub insert into the hub section recess with a substantially uninterrupted bond extending substantially continuously over the conical interface between the hub insert and shell; and forming a central bore having a relatively constant diameter through the hub insert and shell such that the inner periphery of each lie on the same radial plane, said bore being centered generally on the shell central axis, a portion of said bore defined by said shell.

17. The method of claim 16 wherein said shell forming step comprises casting the blade shell from a relatively low inertia material.

18. The method of claim 16 wherein said hub insert forming step comprises forming the hub insert by a noncasting process from a relatively low inertia material.

19. The method of claim 16 wherein said shell forming step further includes forming said shell to have a relatively small gate passage communicating between the apex of the hub section recess and the opposite axial end of the shell.

20. The method of claim 16 wherein said securing step comprises inertia welding the hub insert to the shell.

21. A method of making a centrifugal compressor wheel for turbochargers and the like, comprising the steps of:

forming a blade shell to have a hub section integral with a circumferentially arranged array of centrifugal impeller blades and a generally conical recess in the hub section with a base diameter generally at one axial end of the shell and centered about a shell central axis and an apex disposed generally on the shell central axis, and a relatively small gate passage communicating between the apex of the hub section recess and the opposite axial end of the shell;

forming a hub insert from a material relatively resistant to fatigue failure in comparison with the blade shell to have a size and shape for mating reception into the hub section recess;

securing the hub insert into the hub section recess with a substantially uninterrupted bond extending substantially continuously over the conical interface between the hub insert and shell; and forming a central bore through the hub insert and shell centered generally on the shell central axis, thereby removing the relatively small gate passage.

22. The method of claim 21 wherein said shell forming step comprises casting the blade shell from a relatively low inertia material.

23. The method of claim 21 wherein said hub insert forming step comprises forming the hub insert by a noncasting process from a relatively low inertia material.

24. The method of claim 21 wherein said securing step comprises inertia welding the hub insert to the shell.

25. A method of making a centrifugal compressor wheel for turbochargers and the like, comprising the steps of:

casting a blade shell from a relatively low inertia material to have a hub section integral with a circumferentially arranged array of centrifugal impeller blades and a generally conical recess in the hub section with a base diameter generally at one axial end of the shell and centered about a shell central axis and an apex disposed generally on the shell central axis, and further to include a relatively small gate passage communicating between the apex of the hub section recess and the opposite axial end of the shell;

forming a hub insert from a material relatively resistant to fatigue failure in comparison with the blade shell to have a size and shape for mating reception into the hub section recess;

forming a central bore through the hub insert and shell and thereupon removing the gate passage in the shell; and inertia welding the hub insert into the hub section recess

26. The method of claim 25 including the step of removing upset and flush material from the one axial end of the shell subsequent to said inertia welding step.

27. The method of claim 25 wherein said blade shell casting step comprises forming at least some of the blades to have a forward blade rake generally at one axial end thereof and a rearward curvature generally at the other axial end thereof.

28. The method of claim 25 wherein said hub insert forming step comprises forming the hub insert by a noncasting process from a relatively low inertia material.

* * * * *